US007557792B2

(12) United States Patent
Hong

(10) Patent No.: US 7,557,792 B2
(45) Date of Patent: Jul. 7, 2009

(54) APPARATUS AND METHOD OF DRIVING LIQUID CRYSTAL DISPLAY DEVICE

(75) Inventor: Jin Cheol Hong, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 709 days.

(21) Appl. No.: 10/876,642

(22) Filed: Jun. 28, 2004

(65) Prior Publication Data

US 2005/0128175 A1 Jun. 16, 2005

(30) Foreign Application Priority Data

Dec. 11, 2003 (KR) ..... 10-2003-0090294

(51) Int. Cl.
*G09G 3/36* (2006.01)

(52) U.S. Cl. ..... 345/99

(58) Field of Classification Search ..... 345/89, 345/98, 690, 213
See application file for complete search history.

(56) References Cited

U.S. PATENT DOCUMENTS 6,335,718 B1 * 1/2002 Hong et al. ..... 345/98
2001/0002829 A1 * 6/2001 Nishimura ..... 345/96
2002/0186193 A1 * 12/2002 Lee et al. ..... 345/96
2004/0068594 A1 * 4/2004 Asaro et al. ..... 710/104

FOREIGN PATENT DOCUMENTS

KR WO03094362 A2 * 11/2003
WO WO 03/094362 * 11/2003

* cited by examiner

*Primary Examiner*—Amr Awad
*Assistant Examiner*—Randal Willis
(74) *Attorney, Agent, or Firm*—McKenna Long & Aldridge LLP

(57) ABSTRACT

The present invention relates to a method and an apparatus for driving liquid crystal display device capable of reducing electromagnetic interference by minimizing the number of transitions of data.

An apparatus for driving a liquid crystal display device according to the present includes: a timing controller receiving data from an exterior; an encoding block in the timing controller comparing current pixel data with each of previous pixel data delayed by one line from the current pixel and former pixel data that precedes by one pixel from the current pixel data to produce modified data so as to minimize the number of transitions for each bit; a data driver supplying a video signal to data lines; and a decoding block in the data river recovering the modified data to the current pixel data.

32 Claims, 9 Drawing Sheets

APPARATUS AND METHOD OF DRIVING LIQUID CRYSTAL DISPLAY DEVICE

This application claims the benefit of Korean Patent Application No. P2003-90394, filed on Dec. 11, 2003, which is hereby incorporated by reference for all purposes as if fully set forth herein.

BACKGROUND OF THE INVENTION

1. Field of the Invention

This invention relates to a liquid crystal display device, and more particularly, to an apparatus and a method of driving liquid crystal display device capable of reducing electromagnetic interference (EMI) by minimizing the number of data transitions.

2. Description of the Related Art

In general, a liquid crystal display (LCD) controls light transmittance of liquid crystal cells in accordance with video signals to thereby display a picture. Such devices have been implemented in an active matrix LCD having a switching device for each cell. They have been used as a display device, such as a monitor for a computer, office equipments, a cellular phone and the like. The switching device for the active matrix LCD device employs a thin film transistor (TFT).

FIG. 1 schematically illustrates a related art apparatus for driving an LCD device.

Referring to FIG. 1, the related art LCD driving apparatus includes: a liquid crystal display panel 2 having a plurality of liquid crystal cells Clc arranged in a matrix at the crossings of data lines DL and gate lines GL; a data driver 4 for applying data signals to the data lines; a gate driver 6 for applying scanning signals to the gate lines GL; and a timing controller 8 for controlling the data driver 4 and the gate driver 6 using synchronizing signals H, V and DE supplied from a system 10.

The liquid crystal display panel 2 includes the liquid crystal cells Clc arranged in a matrix at the crossings between the data lines DL and the gate lines GL. A thin film transistor TFT provided at each liquid crystal cell Clc applies a data signal from the data lines DL to the liquid crystal cell Clc in response to a scanning signal from the gate lines GL. Further, each liquid crystal cell Clc is provided with a storage capacitor Cst. The storage capacitor Cst constantly keeps a voltage of the liquid crystal cell Clc.

The data driver 4 converts digital video data R, G and B into analog gamma voltages (i.e., data signals) corresponding to values of gray levels in response to a data control signal DCS from the timing controller 8, and applies the analog gamma voltages to the data lines DL.

The gate driver 6 sequentially applies a scanning pulse to the gate lines GL in response to a gate control signal GCS from the timing controller 8 to select each horizontal line of the liquid crystal display panel 2 to which the data signals are applied.

The system 10 applies vertical/horizontal signals V and H, clock signals DCLK and a data enable signal DE to the timing controller 8.

The timing controller 8 generates the data control signals DCS and the gate control signals GCS for controlling the gate driver 6 and the data driver 4 using the vertical/horizontal synchronizing signals V and H and the clock signal DCLK input from the system 10. The timing controller 8 recovers the data supplied from the system 10 as parallel data to apply the recovered parallel data to the data driver 4.

As described above, the timing controller 8 supplies data for one pixel unit. For example, data for one pixel unit may be 18-bit data: 6-bits for each color red (R), green (G), and blue (B). The timing controller 8 in this example provides the data to the data driver 4 by using 18 data lines, one for each bit. However, when the data of one pixel unit is supplied from the timing controller 8 to the data driver 4, then significant electromagnetic interference (EMI) occurs during the transition of data.

TABLE 1

| | R[0:5] | G[0:5] | B[0:5] |
|---|---|---|---|
| Pn | 000000 | 000000 | 000000 |
| Pn + 1 | 111111 | 111111 | 111111 |

For instance, as illustrated in Table 1, if all of the current pixel data Pn have '0' bits and all of following pixel data Pn+1 have '1' bits, then a data transition occurs at every bit, thereby creating significant EMI. Furthermore, this phenomenon becomes more serious as the size and resolution of the liquid crystal panel 2 is increased. For example, if 24-bit data (8-bit for each of R, G and B) is used for the data of one pixel unit, even more EMI occurs as the number of bits transmitted from the timing controller 8 to the data driver 4 increases.

Thus, a driving apparatus as illustrated in FIG. 2 has been proposed in the related art in order to prevent the generation of the EMI.

FIG. 2 schematically illustrates an LCD driving apparatus according to another embodiment of a related art. In FIG. 2, constituent elements having the same functions as those of FIG. 1 will have the same reference numerals as those of FIG. 1 and therefore detailed explanations therefor will be omitted for the sake of simplicity.

Referring to FIG. 2, the related art LCD driving apparatus includes: a liquid crystal display panel 2 having a plurality of liquid crystal cells Clc arranged in a matrix at the crossings of data lines DL and gate lines GL; a data driver 4 for applying data signals to the data lines; a gate driver 6 for applying scanning signals to the gate lines GL; and a timing controller 12 for controlling the data driver 4 and the gate driver 6 using synchronizing signals H, V and DE supplied from a system 10.

The timing controller 12 generates the data control signals DCS and the gate control signals GCS for controlling the gate driver 6 and the data driver 4 using the vertical/horizontal synchronizing signals V and H and the clock signal DCLK input from the system 10. The timing controller 12 recovers the data supplied from the system 10 as parallel data to apply the recovered parallel data to the data driver 4. Further, the timing controller 12 includes a mode controller 14 for minimizing the number of data transitions.

The mode controller 14 compares a data transition state of the next pixel data to be supplied to the data driver 4 with that of current pixel data being supplied to the data driver 4. That is, the mode controller 14 compares each bit of the next pixel data Pn+1. with each bit of the current pixel data Pn to detect the number of data transitions such as '0→1' or '1→0' and inverts or does not invert the data to be output pursuant to the number of the detected data transitions.

Substantially, the mode controller 14 calculates the number of data transitions and determines whether the number of the calculated data transitions exceeds a threshold value, for example, 9 bits being a half of 18 bits of a total transmitted quantity. Furthermore, whenever the data transition quantity exceeds the threshold value, the mode controller 14 inverts logical values of a mode control signal REV and the next pixel data to be supplied to supply the inverted logical values to the data driver 4.

TABLE 2

| | R[0:5] | G[0:5] | B[0:5] | Data transition quantity | Signal REV |
|---|---|---|---|---|---|
| Pn | 000000 | 000000 | 000000 | 0 | low |
| Pn + 1 | 111111 | 111111 | 111111 | 16 | high |
| Pn + 2 | 000000 | 000000 | 000000 | 16 | low |
| Pn + 3 | 001101 | 111111 | 001110 | 12 | high |
| Pn + 4 | 001101 | 000000 | 001110 | 6 | high |

For instance, as illustrated in Table 2, if all of the current pixel data Pn have '0' bits and all of the next pixel data Pn+1 have '1' bits, then 16 data transitions occurred. In this case, because the data transition becomes more than the threshold value (that is, 9), the logical value of the mode control signal REV is inverted and the next pixel data Pn+1 has a data string of '000000 000000 000000'. At this time, the data driver 4 inverts the data Pn+1 inverts in response to the mode control signal REV to generate a data string of '111111 111111 111111', that is, the original data is recovered).

As described above, the related art LCD driving apparatus compares the current pixel data with the next pixel data and inverts or does not invert the data to be output. Accordingly, it is possible to prevent the generation of high EMI. However, because the related art LCD driving apparatus performs the simple comparison of the current pixel data and the next pixel data to invert or not invert the data, there is a limit to reduce the number of data transitions. In other words, the related art has a limit to reduce the EMI.

SUMMARY OF THE INVENTION

Accordingly, it is an advantage of the present invention to provide an apparatus and a method of driving liquid crystal display capable of reducing an electromagnetic interference (EMI) by minimizing the number of transitions of data.

In order to achieve these and other advantages of the invention, an apparatus for driving a liquid crystal display device according to the present invention includes: a timing controller for receiving data from an exterior; an encoding block, installed in the timing controller, for comparing current pixel data with each of previous pixel data which is delayed by one line from the current pixel data and former pixel data which is preceded by one pixel from the current pixel data to produce modified data so as to minimize the number of transitions for each bit; a data driver for supplying a video signal to data lines; and a decoding block, installed in the data driver, for recovering the modified data to the current pixel data.

The encoding block supplies an inverted or a non-inverted horizontal control signal to the decoding block in response to the comparison result of the current pixel data with the previous pixel data, and wherein the encoding block supplies an enabled or a disabled vertical control signal to the decoding block in response to the number of transitions for each bit.

The encoding block includes: a memory block for sequentially storing the pixel data corresponding to at least one line of the current pixel data as the previous pixel data; a vertical control block for comparing the previous pixel data stored in the memory block with the current pixel data to generate a first data so as to minimize the number of transitions for each bit; a horizontal control block for comparing the current pixel data with the former pixel data to generate a second data so as to minimize the number of transitions for each bit; and an output part for generating the modified data by using any one of the first data supplied from the vertical control block and the second data supplied from the horizontal control block.

The memory block has two line memories, each line memory storing the data supplied from the exterior and supplying the stored data to the vertical control block.

The vertical control block includes: a first comparator for comparing the current pixel data with the previous pixel data to check whether or not the number of transitions for each bit is more than a predetermined threshold value, and for supplying a modification control data if it is checked that the number of transitions for each bit is more than the threshold value and for supplying a maintaining control signal otherwise; a first data generator for generating the first data by inverting or not inverting the current pixel data under a control of the first comparator and for generating a first data transition number corresponding to the number of transitions for each bit between the first data and the previous pixel data; and a first control signal generator for generating a first control signal representative of the inversion or the non-inversion of the first data under a control of the first comparator.

The predetermined threshold value is set to a half of the numbers of overall bits in the pixel data.

The first data generator, in response to the modification control data, inverts the current pixel data to generate the first data.

The first data generator, in response to the maintaining control signal, provides the current pixel data as the first data to the output part.

The first control signal generator generates the first control signal in an enabled state when receiving the modification control signal and wherein the first control signal generator generates the first control signal in a disabled state when receiving the maintaining control signal.

The horizontal control block includes: a second comparator for comparing the current pixel data with the former pixel data to check whether or not the number of transitions for each bit is more than a predetermined threshold value, and for supplying a modification control data if it is checked that the number of transitions for each bit is more than the threshold value, and otherwise, for supplying a maintaining control signal; a second data generator for generating the second data by inverting or non-inverting the current pixel data under a control of the second comparator and for generating a second data transition number corresponding to the number of transitions for each bit between the second data and the former pixel data; and a second control signal generator for generating a second control signal representative of the inversion or the non-inversion of the second data under a control of the second comparator.

The second data generator inverts the current pixel data to generate the second data when receiving the modification control data.

The second data generator, when receiving the maintaining control signal, provides the current pixel data as the second data to the output part.

The second control signal generator generates the second control signal in an enabled state when receiving the modification control signal and wherein the second control signal generator generates the second control signal in a disabled state when receiving the maintaining control signal.

The output part includes: a third comparator for comparing the first data transition number with the second data transition number to produce a first comparison control signal if the first data transition number is larger than the second data transition number and, otherwise, to produce a second comparison control signal; a controller for receiving the first control signal, the second control signal, the first data, the second data and any one of the first comparison control signal and the second comparison control signal; a vertical control signal generator for generating the vertical control signal under a control of the controller; a horizontal control signal generator for generating the horizontal control signal under a control of the controller; and a data generator for the modified data under a control of the controller.

The controller controls the vertical control signal generator to generate the vertical control signal in a disabled state when receiving the first comparison control signal.

The controller controls the vertical control signal generator to generate the vertical control signal in an enabled state when receiving the second comparison control signal.

The controller controls the horizontal control signal generator to invert the horizontal control signal when receiving the second comparison control signal in an enabled state, and, otherwise, the controller controls the horizontal control signal generator to maintain the horizontal control signal as a non-inverted state.

The controller generates the second data as a modified data when receiving both of the first comparison control signal and the disabled second control signal.

The controller generates the second data as the modified data when receiving both of the first comparison control signal and the enabled second control signal.

The controller generates the modified data by using the data generator if the second comparison control signal is provided to the controller.

The controller supplies the first data to the data generator when receiving the second comparison control signal.

The data generator includes: a first exclusive-OR gate for performing an exclusive-OR operation on the first data and the previous pixel data; and a second exclusive-OR gate for performing an exclusive-OR operation on the output of the first exclusive-OR gate and the former pixel data.

The controller generates the output of the second exclusive-OR gate as the modified data.

The decoding block includes: a fourth comparator for checking whether the horizontal control signal is inverted or not to produce a third comparison control signal if it is checked that the horizontal control signal is inverted, and, otherwise, to generate a fourth comparison control signal; a decoding controller for receiving any one of the third comparison control signal and the fourth comparison control signal, the vertical control signal and the modified data; a data inverter for inverting the modified data under a control of the decoding controller; a data recovery part for recovering the modified data under a control of the decoding controller; and a selector for selectively outputting any one of the modified data from the decoding controller, the inverted modified data from the data inverter and the recovered data from the data recovery part, under a control of the decoding controller.

The apparatus for driving the liquid crystal display device further includes: a first delay part, installed in any one input terminal of two input terminals in the fourth comparator, for delaying the horizontal control signal by a time interval during which one pixel data is supplied; a second delay part for delaying the modified data by one pixel to supply the delayed data to the data recovery part; and a memory for sequentially storing the output data from the selector by at least one line to supply the stored data to the data recovery part.

The decoding controller provides the modified data to the selector and controls the selector to output the modified data when receiving the fourth comparison control signal and the vertical control signal in a disabled state.

The decoding controller provides the modified data to the data inverter and controls the selector to output the inverted modified data when receiving the third comparing control signal and the vertical control signal in a disabled state.

The decoding controller recovers the data by using the data recovery part when receiving the enabled vertical control signal.

The decoding controller provides the inverted modified data to the data recovery part when receiving the third comparison control signal, and wherein the decoding controller provides the modified data to the data recovery part when receiving the fourth comparison control signal.

The decoding controller includes: a first exclusive-OR gate for performing an exclusive-OR operation on the inverted modified data or the modified data and the former pixel data; and a second exclusive-OR gate for performing an exclusive-OR operation on the output of the first exclusive-OR gate and the previous pixel data.

The recovered data from the second exclusive-OR gate is provided to the selector and the controller controls the selector so as to output the recovered data from the selector.

The decoding block is installed in the data driver and supplies the recovered data to a plurality of data integrated circuits.

The decoding block is installed in each of data integrated circuits included in the data driver.

A method of driving a crystal display device according to the present invention includes: comparing current data with previous pixel data, which is delayed by one line from the current pixel data and with former pixel data, which is preceded by one pixel from the current pixel data, to produce a modified data so as to minimize the number of transitions for each bit; transmitting the modified data from a timing controller to a data driver; and recovering the transmitted modified data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

These and other advantages of the invention will be apparent from the following detailed description of the embodiments of the present invention with reference to the accompanying drawings, in which.

DETAILED DESCRIPTION OF THE EMBODIMENTS

Reference will now be made in detail to the embodiments of the present invention, examples of which are illustrated in the accompanying drawing.

Hereinafter, the embodiments of the present invention will be described in detail with reference to FIGS. 3 to 9.

Figure 1:
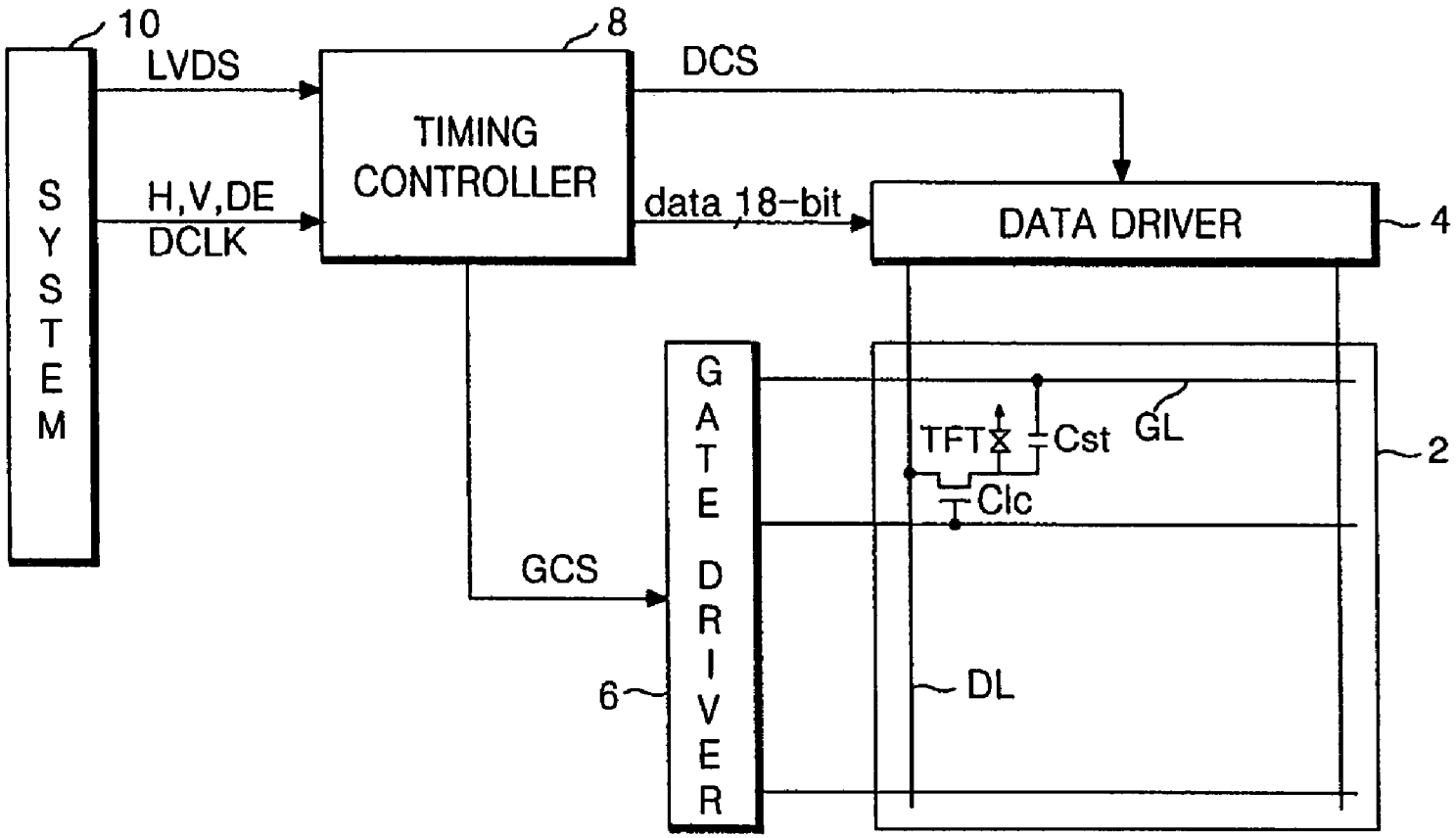
FIG. 1 RELATED ART
FIG. 1 is a schematic configuration representing an LCD driving apparatus of a related art.
Figure 2:
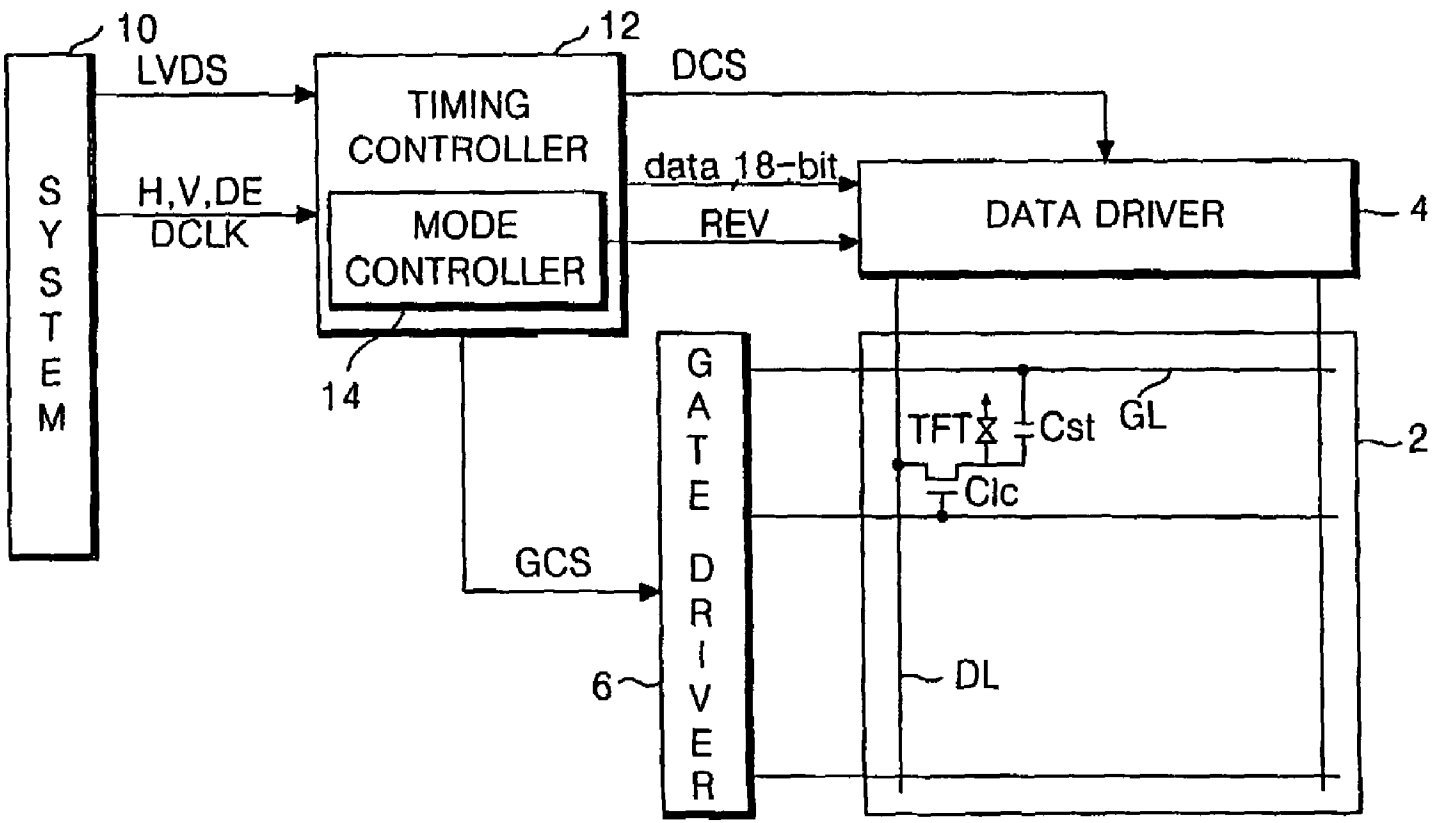
FIG.2 RELATED ART
FIG. 2 is a schematic configuration representing an LCD driving apparatus according to the other embodiment of a related art.
Figure 3:
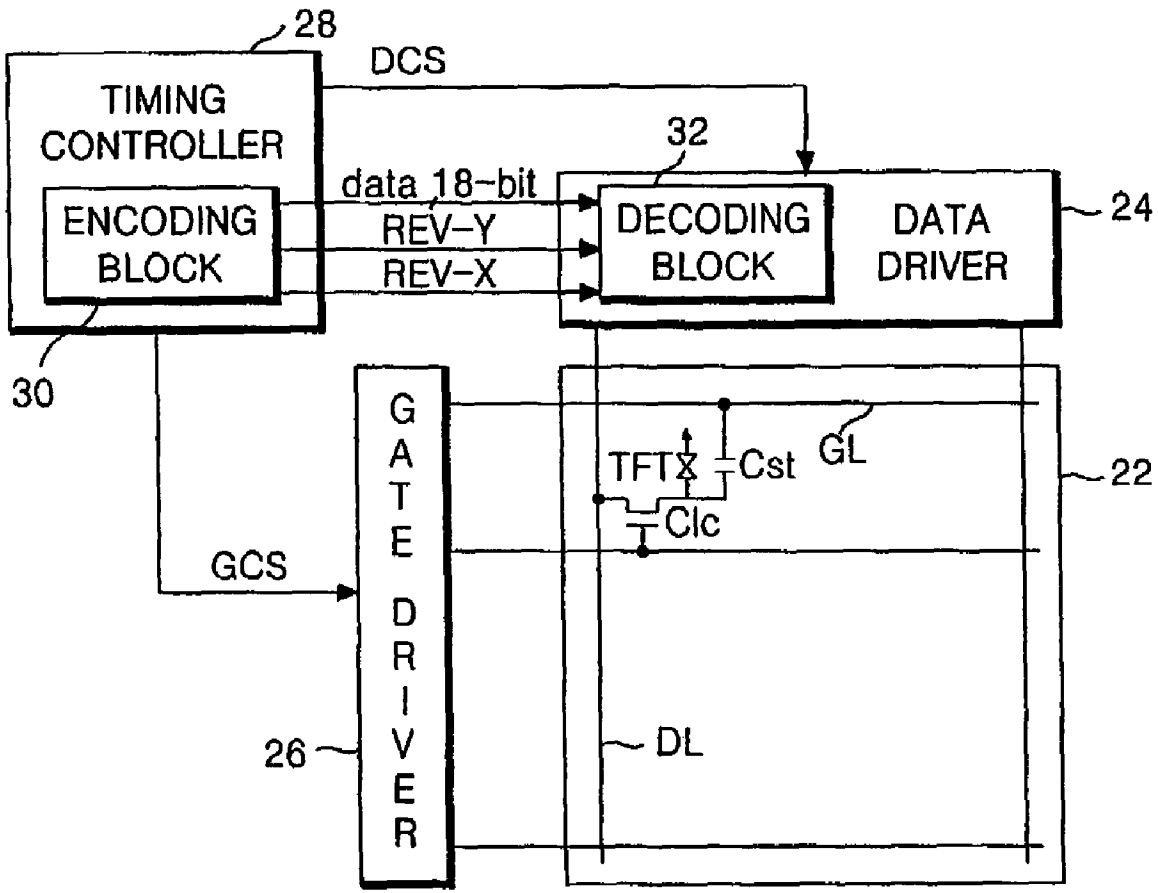
FIG. 3 is a configuration representing an LCD driving apparatus according to the present invention.

FIG. 3 is a configuration representing an LCD driving apparatus according to the present invention.

Referring to FIG. 3, an LCD driving apparatus of the present invention includes: a liquid crystal display panel 22 having a plurality of liquid crystal cells Clc arranged in a matrix at the crossings of data lines DL and gate lines GL; a data driver 24 for applying data signals to the data lines DL; a gate driver 26 for applying scanning signals to the gate lines GL; and a timing controller 28 for controlling the data driver 24 and the gate driver 26 using synchronizing signals supplied from an external system.

The liquid crystal display panel 22 includes the liquid crystal cells Clc arranged in a matrix at the crossings between the data lines DL and the gate lines GL. A thin film transistor TFT provided at each liquid crystal cell Clc applies a data signal from the data lines DL to each of the liquid crystal cell Clc in response to a scanning signal from the gate lines GL. Further, the liquid crystal cell Clc is provided with a storage capacitor Cst. The storage capacitor Cst maintains a substantially constant voltage for the liquid crystal cell Clc.

The data driver 24 converts digital video data R, G and B into analog gamma voltages (i.e., the data signals) corresponding to values of gray levels in response to a data control signal DCS from the timing controller 28, and applies the analog gamma voltages to the data lines DL. To this end, the data driver 24 includes a decoding block 32. The decoding block 32 receives a vertical control signal REV-Y, a horizontal control signal REV-X and a modification data to recover the modification data to an original data by using the vertical control signal REV-Y and the horizontal control signal REV-X. A detailed explanation on the decoding block 32 will be described later.

The gate driver 26 sequentially applies a scanning pulse to the gate lines GL in response to a gate control signal GCS from the timing controller 28 to thereby select a horizontal line of the liquid crystal display panel 22 to which the data signal is supplied.

The timing controller 28 generates the data control signal DCS and the gate control signal GCS for controlling the gate driver 26 and the data driver 24 by using the synchronizing signals provided from the external system. In addition, the timing controller 28 changes the data supplied from the external system to apply the changed data to the data driver 24. The timing controller 28 includes an encoding block 30 for minimizing the number of transitions of current pixel data to be transmitted, by using a previous pixel data which is delayed by one line from the current pixel data and a former pixel data which is preceded by one pixel from the current pixel data.

The encoding block 30 generates a modified data so as to minimize the number of transitions of the present pixel data by a unit of bit by using the previous pixel data and the former pixel data, and supplies the modified data to the decoding block 32. Since the encoding block 30 generates the modified data by using the previous pixel data and the former pixel data, it is possible to reduce the number of transitions of the current pixel data in comparison with the related art.

Figure 4:
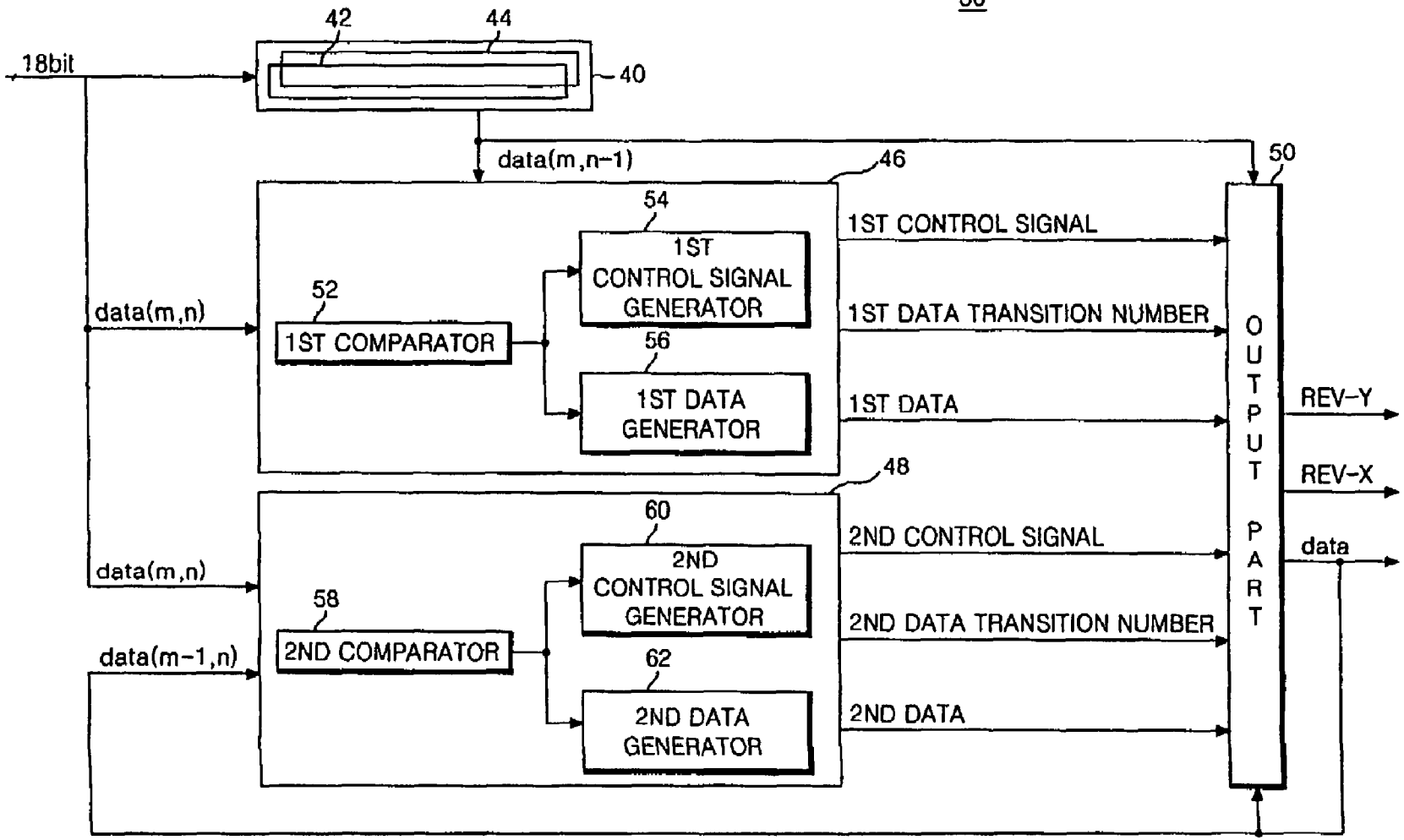
FIG. 4 is a block diagram representing an encoding block illustrated in FIG. 3.
Figure 5:
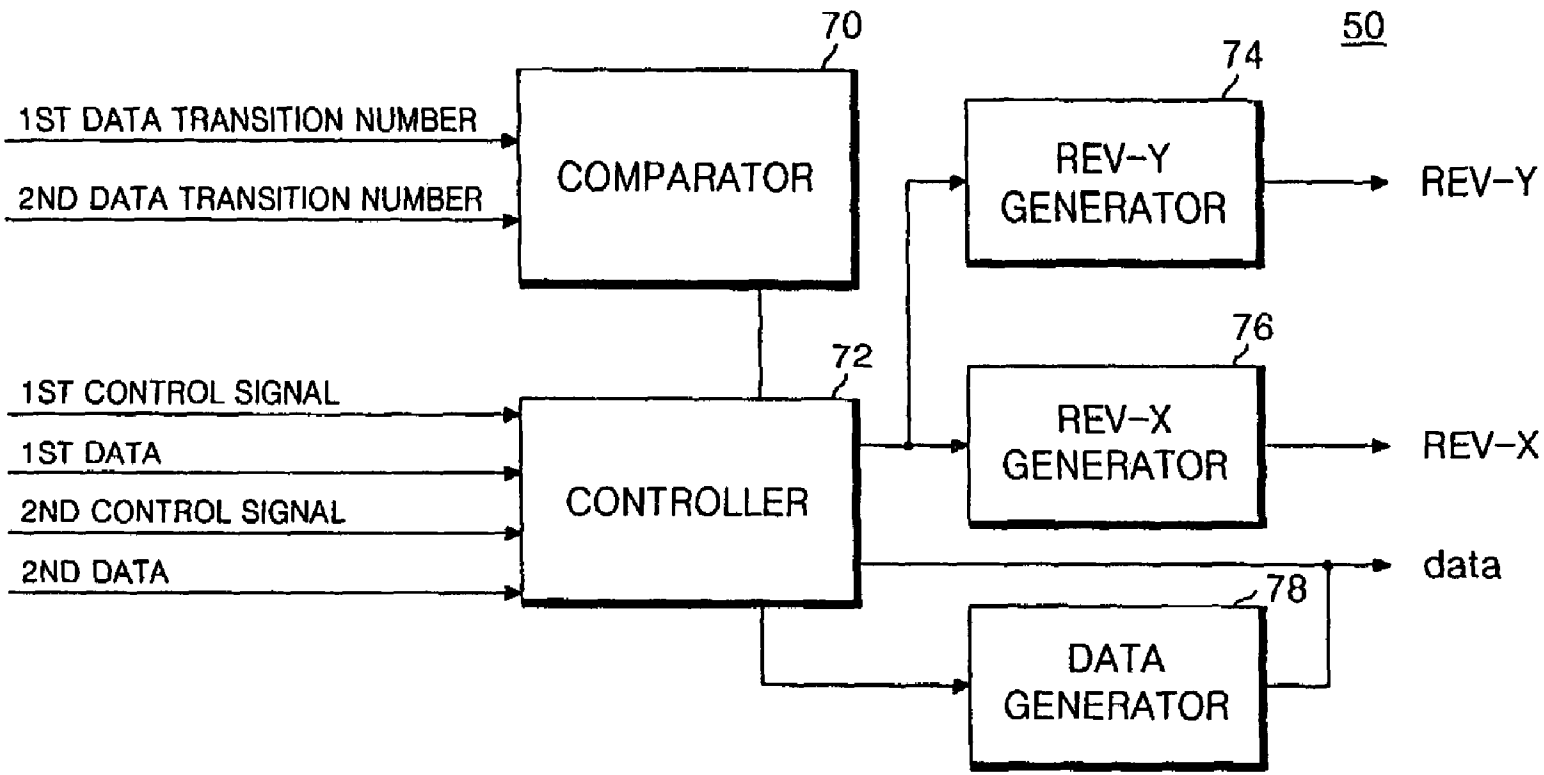
FIG. 5 is a block diagram representing an output part illustrated in FIG. 4.

To this end, the encoding block 30 includes a memory block 40, a vertical control block 46, a horizontal block 48 and an output part 50 as illustrated in FIG. 4.

The memory block 40, including two line memories 42 and 44, stores the current pixel data corresponding to a current horizontal line and supplies the previous pixel data corresponding to a previous horizontal line stored therein to the vertical control block 46.

The vertical control block 46 compares the previous pixel data 'data(m,n−1)' supplied from the memory block 40 with a currently input pixel data 'data(m,n)' (i.e., the current pixel data), to generate a first control signal, a first data transition number and a first data.

The horizontal control block 48 compares the former pixel data (i.e., the modified data 'data') from the output part 50 with the current pixel data data(m,n) to generate a second control signal, a second data transition number and a second data.

The output part 50 generates the modified data (data), the vertical control signal REV-Y and the horizontal control signal REV-X by using the first control signal, the first data transition number and the first data supplied from the vertical control block 46, and the second control signal, the second data transition number and the second data supplied from the horizontal control block 48. The modified data, the vertical control signal REV-Y and the horizontal control signal REV-X generated from the output part 50 are then supplied to the decoding block 32 of the data driver 24.

First of all, operations performed by the vertical control block 46 and the horizontal control block 48 will be described in detail with reference to Table 3.

In Table 3, a reference numeral "data(m, n−1)" represents the previous pixel data which is delayed by one line from the current pixel data (i.e., the previous pixel data) and a reference numeral "data(m, n)" represents the current pixel data. Further, a reference numeral "data(m−1, n)" represents the former pixel data which is preceded by one pixel from the current pixel data, i.e., the former pixel data.

TABLE 3

| | a first case | a second case |
|---|---|---|
| data(m, n − 1) | 000011111000011111 | 000011111000011111 |
| data(m, n) | 110011111111011111 | 110011111111011111 |
| a first control signal | disable | disable |
| a first transition number | 5 | 5 |
| a first data | 110011111111011111 | 110011111111011111 |
| data(m − 1, n) | 1100111111110111110 | 001100000000100001 |
| a second control signal | disable | enable |
| a second transition number | 1 | 1 |
| a second data | 110011111111011111 | 0011000000001000000 |

| | A third case | a fourth case |
|---|---|---|
| data(m, n − 1) | 000011111000011111 | 000011111000011111 |
| data(m, n) | 111110000111110000 | 000011111000011110 |
| a first control signal | enable | disable |
| a first transition number | 2 | 1 |
| a first data | 000001111000001111 | 000011111000011110 |
| data(m − 1, n) | 111111111000001000 | 000011111111111000 |
| a second control signal | enable | disable |
| a second transition number | 8 | 6 |
| a second data | 000001111000001111 | 000011111000011110 |

Referring to Table 3, the operations of the vertical control block 46 and the horizontal control block 46 are classified into four cases, each of which will be described as follows.

In a first case, a first comparator 52 in the vertical control block 46 receives a data string '000011111000011111', which is the previous pixel data data(m, n−1) and a data string '110011111111011111', which is the current pixel data data (m, n). The first comparator 52 calculates the number of transitions of the previous pixel data data(m, n−1) and the current pixel data data(m, n) to determine whether the calculated transition number exceeds a threshold value (e.g., 9 being a half of overall bit numbers). In the first case, because the calculated transition number of the previous pixel data data(m, n−1) and the current pixel data data(m, n) is '5', the first comparator 52 determines that transition number does not exceed the threshold value. Therefore, the first comparator 52 supplies a maintaining control signal to a first control signal generator 54 and a first data generator 56 in the vertical control block 46.

The first data generator 56, in response to the maintaining control signal from the first comparator 52, supplies the data string '110011111111011111', which is the current pixel data data(m, n), as a first data to the output part 50. Also, the first data generator 56 supplies a signal corresponding to '5', which represents the bit transition number of the first data and the previous pixel data data(m, n−1), as a first data transition number to the output part 50.

In addition, the first control signal generator 54, in response to the maintaining control signal from the first comparator 52, supplies a disable signal notifying that the first data does not invert the output part 50.

In the first case, a second comparator 58 in the horizontal control block 48 receives a data string '110011111111011111', which is a current pixel data data (m, n) and a data string of '110011111111011110', which is the former pixel data data(m−1, n). The second comparator 58 calculates the number of transitions of the current pixel data data(m, n) and the former pixel data data(m−1, n) to determined whether the calculated transition number exceeds the threshold value. In this case, because the calculated transition number of the current pixel data data(m, n) and the former pixel data data(m−1, n) is '1', the second comparator 58 determines whether the number of transitions does not exceed the threshold value. Therefore, the second comparator 58 supplies a maintaining control signal to a second control signal generator 60 and a second data generator 62 in the horizontal control block 48.

The second data generator 62, in response to the maintaining control signal from the second comparator 58, supplies a data string of '110011111111011111', which is the current pixel data data(m, n), as a second data to the output part 50. Also, the second data generator 62 supplies a signal corresponding to '1', which represents the bit transition number of the second data and the former pixel data data(m−1, n), as a second data transition number to the output part 50.

In addition, the second control signal generator 60, in response to the maintaining control signal from the second comparator 58, supplies a disable signal, notifying that the first data does not inverted, to the output part 50. That is, in the first case, the first data, the first transition number, the first control signal, the second control signal, the second transition number and the second data are set up as illustrated in Table 3.

In a second case, a first comparator 52 in the vertical control block 46 receives a data string '000011111000011111', which is the previous pixel data data(m, n−1) and a data string of '110011111111011111', which is the current pixel data data(m, n). The first comparator 52 calculates the number of transitions of the previous pixel data data(m, n−1) and the current pixel data data(m, n) to determine whether the calculated transition number exceeds the threshold value. In the second case, because the number of transitions of the previous pixel data data(m, n−1) and the current pixel data data(m, n) is '5', the first comparator 52 determines that the number of transitions does not exceed the threshold value. According to this, the first comparator 52 supplies a maintaining control signal to a first control signal generator 54 and a first data generator 56 in the vertical control block 46.

The first data generator 56, in response to the maintaining control signal from the first comparator 52, supplies the data string '110011111111011111', which is the current pixel data data(m, n), as a first data to the output part 50. Also, the first data generator 56 supplies a signal corresponding to '5', which represents the bit transition number of the first data and the previous pixel data data(m, n−1), as a first data transition number to the output part 50.

In addition, the first control signal generator 54, in response to the maintaining control signal from the first comparator 52, supplies a disable signal notifying that the first data is not inverted, to the output part 50.

In the second case, a second comparator 58 in the horizontal control block 48 receives a data string '110011111111011111', which is a current pixel data data (m, n) and a data string '001100000000100001', which is a former pixel data data(m−1, n). The second comparator 58 calculates the transition number of the current pixel data data(m, n) and the former pixel data data(m−1, n) to determined whether the calculated transition number exceeds a threshold value. In this case, because the calculated transition number of the current pixel data data(m, n) and the former pixel data data(m−1, n) is '16', the second comparator 58 determines that the transition number exceed the threshold value. Therefore, the second comparator 58 supplies a modification control signal to a second control signal generator 60 and a second data generator 62 in the horizontal control block 48.

The second data generator 62, in response to the modification control signal from the second comparator 58, supplies the data string '001100000000100000', which the current pixel data data(m, n) is inverted, as a second data to the output part 50. Also, the second data generator 62 supplies a signal corresponding to '1', which represents the bit transition number of the second data and the former pixel data data(m−1, n), as a second data transition number to the output part 50.

In addition, the second control signal generator 60, in response to the modification control signal from the second comparator 58, supplies an enable signal notifying that the second data is inverted, to the output part 50. That is, in the second case, the first data, the first transition number, the first control signal, the second control signal, the second transition number and the second data are set up as illustrated in Table 3.

In a third case, a first comparator 52 in the vertical control block 46 receives a data string '000011111000011111', which is the previous pixel data data(m, n−1) and a data string '111110000111110000', which is the current pixel data data (m, n). The first comparator 52 calculates the number of transitions of the previous pixel data data(m, n−1) and the current pixel data data(m, n) to determine whether the calculated transition number exceeds a threshold value. In the third case, because the number of transitions of the previous pixel data data(m, n−1) and the current pixel data data(m, n) is '16', the first comparator 52 determines that transition number exceeds the threshold value. Therefore, the first comparator 52 supplies a modification control signal to a first control signal generator 54 and a first data generator 56.

The first data generator 56, in response to the modification control signal from the first comparator 52, supplies the data string '000001111000001111', which the present pixel data '111110000111110000' is inverted, as a first data to the output part 50. Also, the first data generator 56 supplies a signal corresponding to '2', which represents the bit transition number of the first data and the previous pixel data data(m, n−1), as a first data transition number to the output part 50.

In addition, the first control signal generator 54, in response to the modification control signal from the first comparator 52, supplies an enable signal notifying that the first data is inverted to the output part 50.

In the third case, a second comparator 58 in the horizontal control block 48 receives a data string of '111110000111110000', which is a current pixel data data (m, n) and a data string of '111111111000001000', which is a former pixel data data(m−1, n). The second comparator 58 calculates the number of transitions of the current pixel data data(m, n) and the former pixel data data(m−1, n) to determined whether the calculated transition number exceeds a threshold value. In this case, because the calculated transition number of the current pixel data data(m, n) and the former pixel data data(m−1, n) is '10', the second comparator 58 determines that the number of transitions exceeds the threshold value. Therefore, the second comparator 58 supplies a modification control signal to a second control signal generator 60 and a second data generator 62 in the horizontal control block 48.

The second data generator 62, in response to the modification control signal from the second comparator 58, supplies the data string '000001111000001111', which the current pixel data data(m, n) is inverted, as a second data to the output part 50. Also, the second data generator 62 supplies a signal corresponding to '8', which represents the bit transition number of the second data and the former pixel data data(m−1, n), as a second data transition number to the output part 50.

In addition, the second control signal generator 60, in response to the modification control signal from the second comparator 58, supplies an enable signal notifying that the second data is inverted to the output part 50. That is, in the third case, the first data, the first transition number, the first control signal, the second control signal, the second transition number and the second data are set up as illustrated in Table. 3.

In a fourth case, a first comparator 52 in the vertical control block 46 receives a data string '000011111000011111', which is the previous pixel data data(m, n−1) and a data string '000011111000011110', which is the present pixel data. The first comparator 52 calculates the number of transitions of the previous pixel data data(m, n−1) and the current pixel data data(m, n) to determine whether the calculated transition number exceeds a threshold value. In the fourth case, because the number of transitions of the previous pixel data data(m, n−1) and the current pixel data data(m, n) is '1', the first comparator 52 determines that transition number does not exceed the threshold value. Therefore, the first comparator 52 supplies a maintaining control signal to a first control signal generator 54 and a first data generator 56.

The first data generator 56, in response to the maintaining control signal from the first comparator 52, supplies the data string '000011111000011110', which is the current pixel data data(m, n), as a first data to the output part 50. Also, the first data generator 56 supplies a signal corresponding to '1', which represents the bit transition number of the first data and the previous pixel data data(m, n−1), as a first data transition number to the output part 50.

In addition, the first control signal generator 54, in response to the maintaining control signal from the first comparator 52, supplies a disable signal notifying that the first data does not invert the output part 50.

In the fourth case, a second comparator 58 of the horizontal control block 48 receives a data string '000011111000011110', which is a current pixel data data (m, n) and a data '000011111111111000', which is the former pixel data data(m−1, n). The second comparator 58 calculates the transition number of the current pixel data data(m, n) and the former pixel data data(m−1, n) to determine whether the calculated transition quantity exceeds the threshold value. In this case, because the calculated transition number of the current pixel data data(m, n) and the former pixel data data(m−1, n) is '6', the second comparator 58 determines that the number of transitions does not exceed the threshold value. Therefore, the second comparator 58 supplies a maintaining control signal to a second control signal generator 60 and a second data generator 62 in the horizontal control block 48.

The second data generator 62, in response to the maintaining control signal from the second comparator 58, supplies the data string '000011111000011110', which is the current pixel data data(m, n), as a second data to the output part 50. Also, the second data generator 62 supplies a signal corresponding to '6', which represents the bit transition number of the second data and the former pixel data data(m−1, n), as a second data transition number to the output part 50.

In addition, the second control signal generator 60, in response to the maintaining control signal from the second comparator 58, supplies a disable signal notifying that the first data does not inverted to the output part 50. That is, in the fourth case, the first data, the first transition number, the first control signal, the second control signal, the second transition number and the second data are set up as illustrated in Table. 3.

In the first to the fourth cases, an operation on the output part 50 will be described in detail with reference to Table 4.

TABLE 4

| | a first case | a second case |
|---|---|---|
| a first data | 110011111111011111 | 110011111111011111 |
| a second data | 110011111111011111 | 001100000000100000 |
| REV-Y | disable | disable |
| REV-X | maintaining | inverting |
| data | 110011111111011111 | 001100000000100000 |
| | **a third case** | **a fourth case** |
| a first data | 000001111000001111 | 000011111000011110 |
| a second data | 000001111000001111 | 000011111000011110 |
| REV-Y | enable | enable |
| REV-X | inverting | maintaining |
| data | 111101111000011000 | 000011111111111001 |

In Table 4, a reference numeral "REV-Y" represents a vertical control signal, a reference numeral "REV-X" represents a horizontal control signal, and a reference numeral "data" represents a modified data. Herein, the vertical control signal REV-Y, the horizontal control signal REV-X and the modified data are supplied to the decoding block 32.

The operation on the output part 50 will be described in detail with reference to Tables 3, 4 and 5. First of all, the output part 50 includes: a comparator 70 for comparing the first data transition number and the second data transition number; and a controller 72 for controlling a REV-Y generator 74, a REV-X generator 76 and a data generator 78 by using a comparing control signal from the comparator 72, the first control signal, the first data, the second control signal and the second data.

In a first case, the comparator 70 of the output part 50 receives the first data transition number and the second data transition number. The comparator 70 compares the first data transition number with the second data transition number to generate to comparison control signal and then supplies the comparison control signal to the controller 72. In the first case, the second data transition number is low. Therefore, the comparator 70 provides the comparison control signal representing that the second data transition number is low for example, a first comparison control signal, to the controller 72.

The controller 72 receives the first comparison control signal, the first control signal, the second control signal, the first data and the second data. The controller 72, in response to the first comparison control signal, controls the REV-Y generator 74 so as to supply a disabled vertical control signal REV-Y. Accordingly, the REV-Y generator 74 supplies the disabled vertical control signal REV-Y to the decoding block 32. Substantially, when the first comparison control signal is provided from the comparator 70, the REV-Y generator 74 usually supplies the disabled vertical control signal REV-Y to the decoding block 32 under a control of the controller 72.

Furthermore, the controller 72 controls the REV-X generator 76 in response to the second control signal. In the first case, because the second control signal is in a disabled state as denoted in Table 3, the controller 72 controls the REV-X generator 76 to maintain a former horizontal control signal REV-X. Accordingly, the REV-X generator 76 supplies a horizontal control signal REV-X having a polarity, e.g., logical low or logical high, identical to that of the former horizontal control signal REV-X to the decoding block 32. Substantially, when the second control signal is in a disable state, the controller 72 controls the REV-X generator 76 so as to maintain a former horizontal control signal REV-X. However, when the second control signal is in an enabled state, the controller 72 controls the REV-X generator 76 so as to invert a former horizontal control signal REV-X.

Meanwhile, if the first comparison control signal is supplied, the modified data (data) is selected as the second data. In other words, the second data is supplied, as the modified data, to the decoding block 32. Herein, if the comparison is made between former pixel data data(m−1, n) and the modified data (data), it can be known that only one bit is transited therebetween. Thus, the present invention is capable of minimizing the EMI.

In a second case, the comparator 70 receives the first data transition number and the second data transition number. The comparator 70 compares the first data transition number and the second data transition number to generate a comparison control signal and then supplies the comparison control signal to the controller 72. In the second case, because the second data transition number is low, the comparator 70 supplies the first comparison control signal corresponding thereto to the controller 72.

The controller 72, receiving the first comparison control signal, controls the REV-Y generator 74 so as to supply a disabled vertical control signal REV-Y. Accordingly, the REV-Y generator 74 supplies the disabled vertical control signal REV-Y to the decoding block 32. Furthermore, the controller 72 controls the REV-X generator 76 so as to invert a former horizontal control signal REV-X in response to the enabled second control signal. Accordingly, the REV-X generator 76 supplies the horizontal control signal REV-X, inverted to the former horizontal control signal REV-X, to the decoding block 32.

Meanwhile, if the first comparison control signal is supplied, the modified data (data) is selected as the second data. In other words, the second data is supplied, as the modified data (data), to the decoding block 32. Herein, if the comparison is made between former pixel data data(m−1, n) and the modified data (data), it can be known that only one bit is transited. Thus, the present invention is capable of minimizing the EMI.

In a third case, the comparator 70 receives the first data transition number and the second data transition number. The comparator 70 compares the first data transition number and the second data transition number to generate a comparison control signal and then supplies the comparison control signal to the controller 72. In the third case, because the first data transition number is low, the comparator 70 supplies the second comparison control signal corresponding thereto to the controller 72.

The controller 72, receiving the second comparison control signal, controls the REV-Y generator 74 so as to supply an enabled vertical control signal REV-Y. Accordingly, the REV-Y generator 74 supplies the enabled vertical control signal REV-Y to the decoding block 32. Substantially, when the controller 72 receives the second comparison control signal, that is, when the first data transition number is small, the controller 72 controls the REV-Y generator 74 so as to supply the enabled vertical control signal REV-Y. Furthermore, the controller 72 controls the REV-X generator 76 so as to invert a former horizontal control signal REV-X in response to the enabled second control signal. Accordingly, the REV-X generator 76 supplies the horizontal control signal REV-X, inverted to the former horizontal control signal REV-X, to the decoding block 32.

Figure 6:
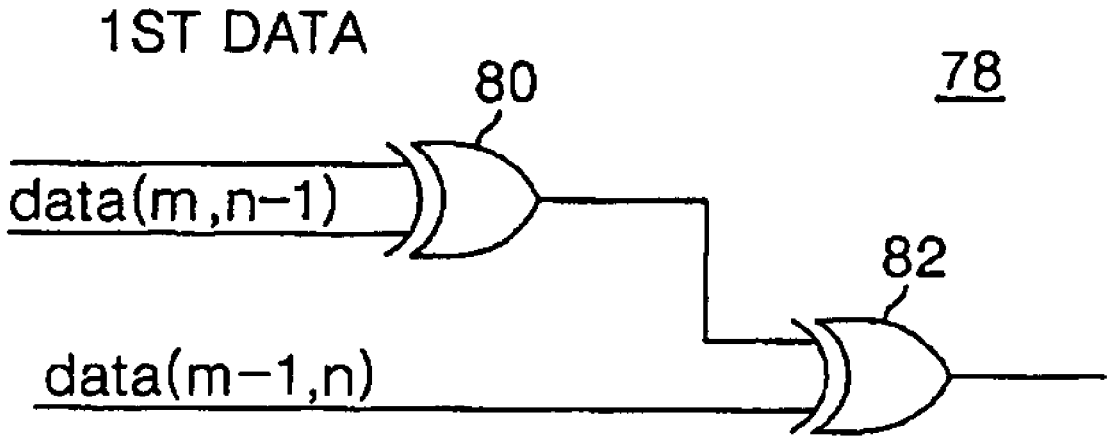
FIG. 6 is a circuit diagram representing a generator illustrated in FIG. 5.
Figure 7:
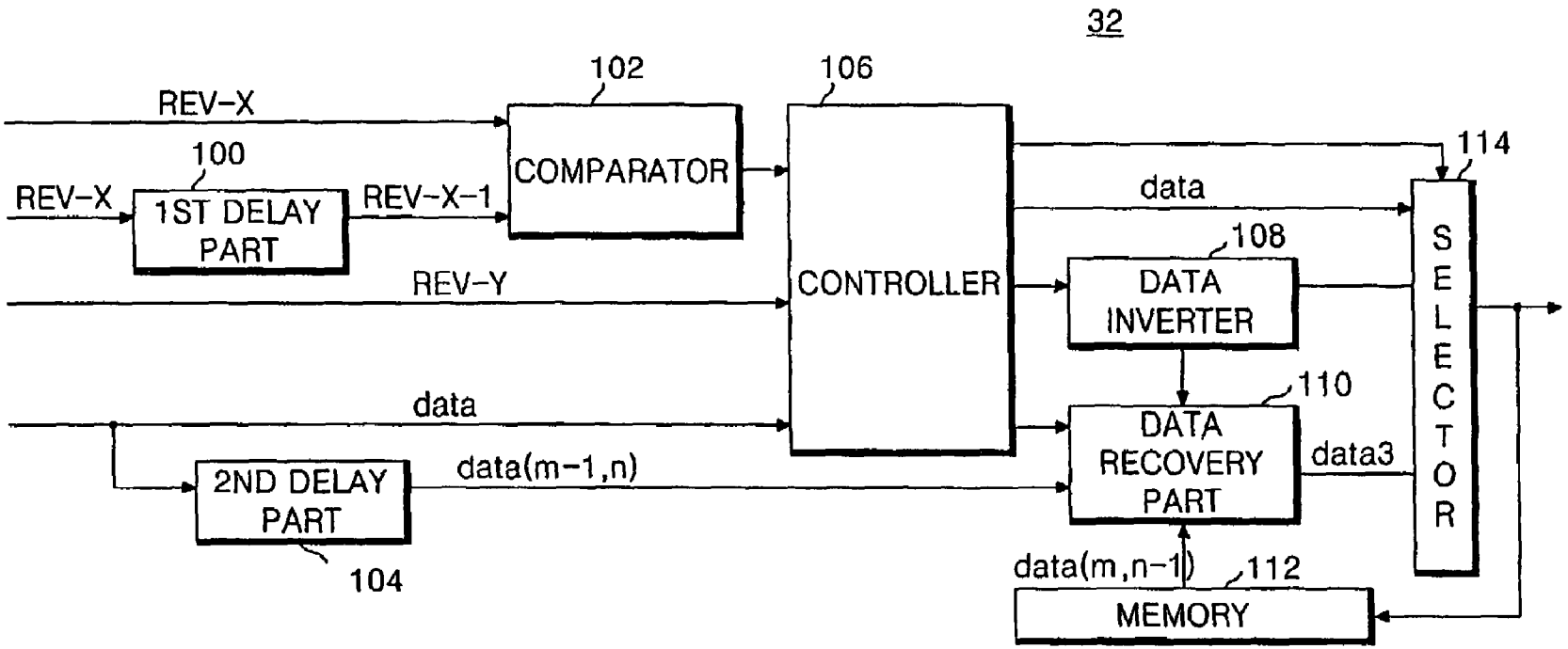
FIG. 7 is a block diagram representing a decoding block illustrated in FIG. 3.

Meanwhile, if the second comparison control signal is supplied to the controller 72, then the controller 72 generates a modified data (data) by using the data generator 78. To this end, the data generator 78 includes two Exclusive-OR (hereinafter, exclusive-OR is XOR) gates 80 and 82 as illustrated in FIG. 6. The first XOR gate 80 receives the first data and the previous pixel data data(m, n−1). The second XOR gate 82 receives an output of the first XOR gate 80 and the former data data(m−1, n).

In operation, if the second comparison control signal is supplied to the controller 72, then the controller 72 supplies the first data to the first XOR gate 80. Then, the first XOR gate 80 performs an Exclusive-OR operation on the first data of '000001111000001111' and the previous pixel data data(m, n−1) of '000011111000011111'. Then the first XOR gate 80 outputs a data string of '000010000000010000'. The output of the XOR gate 80 is input to the XOR gate 82 in which an Exclusive-OR operation is performed on the former pixel data data(m−1, n) of '111111111000010000' and the output of the XOR gate 80. Then, the second XOR gate 82 outputs a data string of '111101111000011000'. Herein, if the comparison is made between former pixel data data(m−1, n). and the modified data, it can be known that only two bits are transited therebetween. Accordingly, the present invention is capable of minimizing the EMI. In particular, in the third case, in case of the related art, eight bits are transited since the second data is output as the modified data. However, in case of the present invention, since only two bits are transited, the present invention is capable of reducing the EMI in comparison with the related art.

In a fourth case, the comparator 70 receives the first data transition number and the second data transition number. The comparator 70 compares the first data transition number and the second data transition number to generate a comparison control signal and then supplies the comparison control signal to the controller 72. In the fourth case, because the first data transition number is low, the comparator 70 supplies the second comparison control signal corresponding thereto to the controller 72.

The controller 72, receiving the second comparison control signal, controls the REV-Y generator 74 so as to supply an enabled the vertical control signal REV-Y. Accordingly, the REV-Y generator 74 supplies the enabled vertical control signal REV-Y to the decoding block 32. Also, the controller 72, receiving the second control signal, controls the REV-X generator 76 so as to maintain a former horizontal control signal REV-X. Accordingly, the REV-X generator 76 supplies the horizontal control signal REV-X, identical to the former horizontal control signal, to the decoding block 32.

Meanwhile, if the second comparison control signal is supplied to the controller 72, then the controller 72 generates a modified data by using the data generator 78. In operation, firstly, if the second comparison control signal is supplied to the controller 72, the controller 72 supplies the first data to the first XOR gate 80. Then, the first XOR gate 80 performs an Exclusive-OR operation on the first data of '000011111000011110' and the previous pixel data data(m, n−1) of '000011111000011111'. At this time, the first XOR gate 80 outputs a data string of '000000000000000001'. The output of the XOR gate 80 is input to the XOR gate 82 in which an Exclusive-OR operation is performed on the former pixel data data(m−1, n) of '000011111111111000' and the output of the XOR gate 80. Then, the second XOR gate 82 outputs a data string of '000011111111111001'. Herein, the output of the second XOR gate 82 is supplied as the modified data to the decoding block 32. Herein, if the comparison is made between former pixel data data(m−1, n) and the modified data, it can be known that only one bit is transited. Accordingly, the present invention is capable of minimizing the EMI. In particular, in the fourth case, in case of the related art, six bits are transited since the second data is output as the modified data. However, in case of the present invention, since only one bit is transited, the present invention is capable of reducing the EMI in comparison with the related art.

Meanwhile, the vertical control signal REV-Y, the horizontal control signal REV-X and the modified data transmitted from the encoding block 30 are supplied to the decoding block 32. The decoding block 32 recovers the modified data (data) to an original data by using the vertical control signal REV-Y and the horizontal control signal REV-X.

To this end, the decoding block 32 includes: a first delay part 100 for delaying the horizontal control signal REV-X by a unit of one pixel; a comparator 102 for comparing the horizontal control signal REV-X supplied from the encoding block 30 with the delayed horizontal control signal REV-X-1 from the first delay part 100; a controller 106 for receiving a comparison control signal from the comparator 102, and the vertical control signal REV-Y and the modified data (data); a second delay part 104 for delaying the modified data (data) by a unit of one pixel; a data inverter 108 for inverting the modified data under a control of the controller 106; a data recovery part 110 for recovering the modified data (data) to the original data under a control of the controller 106; and a selector 114 for selecting any one of the modified data (data) supplied from the controller 106, the inverted modified data (data) supplied from the data inverter 108 and the recovered data (data3 ) supplied from the data recovery part 110.

The decoding block 32 further includes a memory 112 for storing the recovered data from the selector 114 by a unit of one line.

The operation of the decoding block will be explained in detail with reference to Tables 3 and 4. First, in the first case, the controller 106 receives a disabled vertical control signal REV-Y. Also, the controller 106 receives a third comparison control signal notifying that the horizontal control signal REV-X from the comparator 102 is maintaining the same polarity. That is, in the first case, because the horizontal control signal REV-X is maintained with its polarity identical to that of the previous horizontal control signal, the delayed horizontal control signal REV-X supplied from the delay part 100 and the horizontal control signal REV-X supplied from the encoding block 30 have the polarity identical with each other. At this time, the comparator 102 supplies the third comparison control signal to the controller 106.

The controller 106, in response to a disabled vertical control signal REV-Y and the third comparison control signal, supplies a modified data (data) provided thereto to the selector 114. And the controller 106 controls the selector 114 so that the selector 114 outputs the modified data as the recovered data. That is, in the first case, the modified data (data) is supplied to a drive integrated circuit(IC). Meanwhile, as illustrated in Tables 3 and 4, since the current pixel data data(m, n) and the modified data (data) are same as each other, it is possible to display a desired picture in the first case.

In the second case, the controller 106 receives a disabled vertical control signal REV-Y. Also, the controller 106 receives a fourth comparison control signal indicating that the horizontal control signal REV-X from the comparator 102 had been inverted. That is, in the second case, because the horizontal control signal REV-X is inverted, the delayed horizontal control signal REV-X supplied from the delay part 100 and the horizontal control signal REV-X supplied from the encoding block 30 have polarities different from each other. At this time, the comparator 102 supplies the fourth comparison control signal to the controller 106.

The controller 106, in response to the disabled vertical control signal REV-Y and the fourth comparison control signal, supplies a modified data (data) to the data inverter 108. (Substantially, when the vertical the disabled control signal REV-Y is supplied to the controller 106, the controller 106 does not control the data recovery part 110.) The data inverter 108 inverts the data supplied thereto, and then supplies the inverted data to the selector 114. Herein, because a data string of '001100000000100000' is supplied to the data inverter 108, as a modified data (data), the data inverter 108 supplies the inverted data of '110011111111011111' to the selector 114. At this time, the controller 106 controls the selector 114, so that the data supplied form the data inverter 108 is output as the recovered data. That is, in the second case, the modified data (data) is inverted and then is supplied to the drive IC. Meanwhile, as illustrated in Tables 3 and 4, since the current pixel data data(m, n) and the inverted data are same each other for every bit, it is possible to display a desired picture in the second case.

In the third case, the controller 106 receives an enabled vertical control signal REV-Y. Also, the controller 106 receives a fourth comparison control signal indicating that the horizontal control signal REV-X from the comparator 102 had been inverted.

Figure 8:
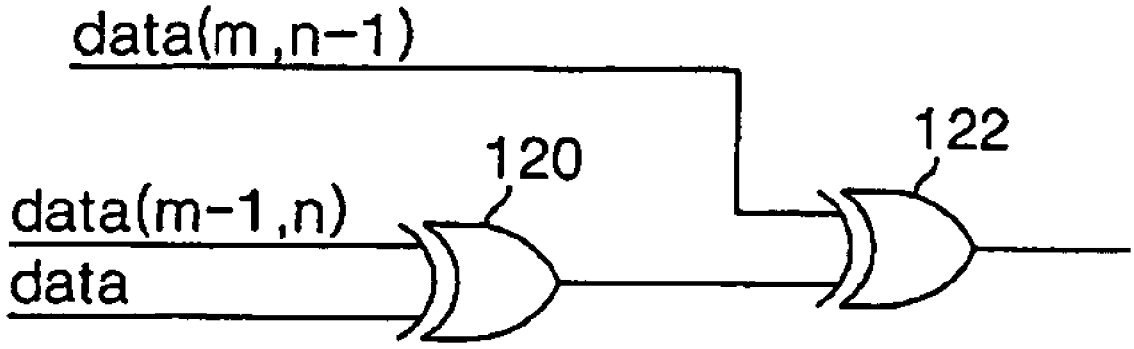
FIG. 8 is a circuit diagram representing a data recovery part illustrated in FIG. 7.

The controller 106, in response to the fourth comparison control signal, supplies a modified data (data) to the data inverter 108. Also, the controller 106, receiving the enabled vertical control signal, controls the data recovery part 110 to recover the data. To this end, as illustrated in FIG. 8, the data recovery part 110 includes the first XOR gate 120 and the second XOR gate 122. The first XOR gate receives a modified data (data) modified under a control of the controller 106 (herein, the modified data (data) is inverted or non-inverted and then is input to the first XOR gate 120) and a former pixel data data(m−1, n). The second XOR gate 122 receives an output of the first XOR gate 120 and a previous pixel data data(m, n−1).

In operation of the data recovery part 110, because the fourth comparison control signal is supplied to the controller 106, the first XOR gate 120 receives a data string of '000010000111100111', which is the modified data (data) inverted from the data inverter 108, and a data string of '111111111000001000', which is the former data data(m−1, n) delayed from the second delay part 104. At this time, the first XOR gate 120 outputs a data string of '111101111111101111'. The second XOR gate 122 receives the data string of '111101111111101111', which is the output of the first XOR gate 120, and the data string of '000011111000011111', which is the previous pixel data data(m, n−1) supplied from the memory 112. At this time, the second XOR gate 122 outputs the data string of '111100000111110000'. The data string of '111100000111110000' from the second XOR gate 120 is supplied as the recovered data to the selector 114. At this time, the controller 106 controls the selector 114 so that the selector 114 selects the recovered data form the data recovery part 110 to be output as the recovered data. That is, in the third case, the recovered data from the data recovery part 110 is supplied to the drive IC. Meanwhile, as illustrated in Tables 3 and 4, because the current data data(m, n) and the recovered data are same in each bit, it is possible to display a desired picture in the third case.

In the fourth case, the controller 106 receives an enabled vertical control signal REV-Y. Also, the controller 106 receives a third comparison control signal notifying that the horizontal control signal REV-X from the comparator 102 is not inverted.

The controller 106, in response to the enabled vertical control signal REV-Y and the third comparison control signal, supplies the modified data (data) to the data recovery part 110. The data recovery part 110 recovers the modified data (data) to the original data and then supplies the recovered data to the selector 114. In operation of the data recovery part 110, the first XOR gate 120 receives the data string of '000011111111111001', which is the modified data from the controller, and the data string of '000011111111111000', which is the former pixel data data(m−1, n) delayed by the second delay part 104. At this time, the first XOR gate 122 outputs a data string of '000000000000000001'. The second XOR gate 122 receives the data string of '000000000000000001', which is the output of the first XOR gate 120, and the data string of '000011111000011111', which is the previous pixel data data(m, n−1) supplied from the memory 112. At this time, the second XOR gate 122 outputs a data string of '000011111000011110'. The data string of '000011111000011110' from the second XOR gate 122 is then supplied as the recovered data to the selector 114. At this time, the controller 106 controls the selector 114 so that the selector 114 selects the output form the data recovery part 110 to be output as the recovered data. That is, in the fourth case, the recovered data from the data recovery part 110 is supplied to the drive IC. Meanwhile, as illustrated in Tables 3 and 4, since the current input data data(m, n) and the recovered data are same in each bit, it is possible to display a desired picture in the fourth case.

As described in the examples of the first case through the fourth case, the decoding block 32 can accurately recovery the data supplied from the encoding block 30. Accordingly, the present invention is capable of displaying the desired picture in the liquid crystal panel 22. In addition, the present invention is capable of minimizing the data transition number by using a former pixel data and a previous pixel data, which results in minimizing the EMI. Meanwhile, in the present invention, the decoding block 32 may be installed in front of, i.e. before, the drive IC in order to recover the data before being supplied to the drive IC. Also, in the present invention, the decoding block 32 may be installed in each of the drive ICs.

Figure 9:
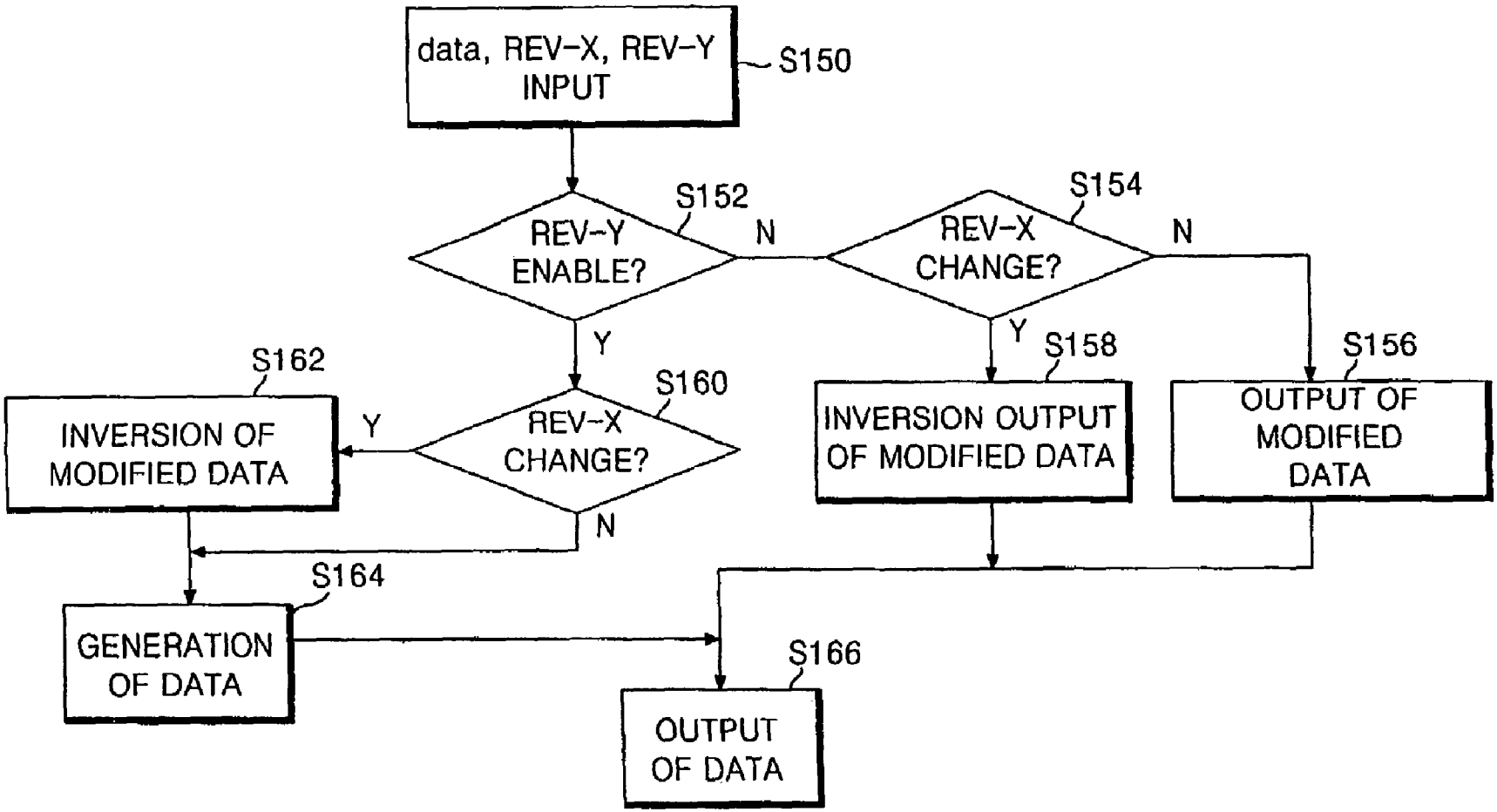
FIG. 9 is flow chart representing an operating process of the decoding block illustrated in FIG. 7.

FIG. 9 is flow chart briefly illustrating the operation of the decoding block according to the embodiment of the present invention.

Referring to FIG. 9, at step S150, the modified data (data), the horizontal control signal REV-X and the vertical control signal REV-Y are supplied from the encoding block 30 to the decoding block. Then, at step S152, the controller 105 checks whether the vertical control signal REV-Y is an enable signal. At step S154, if the vertical control signal REV-Y is not the enable signal, then the controller 106 checks whether the horizontal control signal REV-X is changed or not. A signal representing the presence or absence of the change of the horizontal control signal REV-X is provided from the comparator 102. At steps S156 and S166, if it is checked that the horizontal control signal REV-X is not changed at S154, then the controller 106 outputs the modified data (data) provided thereto as the recovered data.

Meanwhile, if the horizontal control signal REV-X is changed at step S154, then the controller 106 supplies the modified data (data) to the data inverter 108. Then, at step S158, the data inverter 108 inverts the modified data (data). Thereafter, at step 166 S166, the controller 106 outputs the inverted modified data (data) as the recovered data.

At step S160, if the vertical control signal REV-Y is the enable signal at step S152, then the controller 106 checks if the horizontal control signal REV-X is changed. If the horizontal control signal REV-X is not changed at step S160, the controller 106 supplies the modified data to the data recovery part 110. Then, at step S164, the data recovery part 110 generates the recovered data by using the modified data (data). Thereafter, at step S166, the controller 106 outputs the recovered data.

At step S162, if the horizontal control signal REV-X is changed at step S160, then the controller 106 supplies the modified data (data) to the data inverter 108. The data inverter 108 inverts the modified data (data) and then supplies the inverted data to the data recovery part 110. Then, at step S164, the data recovery part 110 generates a recovered data by using the inverted modified data (data). Thereafter, at step S166, the controller 106 outputs the recovered data.

As described above, according to an apparatus and a method of driving liquid crystal display of the present invention, a former pixel data and a current pixel data are compared each other and a current pixel data and a previous pixel data are compared each other to produce a modified data with a small transition number, which will then be supplied to a data driver. Thus, it is possible to reduce the EMI.

Although the present invention has been explained by the embodiments illustrated in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving a liquid crystal display device comprising:

a timing controller that receives data for a sequence of lines of pixels for a display from outside the timing controller;

an encoding block, in the timing controller, generating a first data, a first control signal and a first data transition number by comparing current pixel data with previous pixel data delayed by one line from the current pixel data generating a second data, a second control signal and a second data transition number by comparing the currently pixel data with former pixel data which is preceded by one pixel from the current pixel data, and generating modified data, a vertical control signal and a horizontal control signal by using the first and second data, the first and second control signals and the first and second data transition numbers so as to minimize the number of transitions for each bit;

a data driver that supplies a video signal to data lines; and a decoding block, installed in the data driver, that recovers the modified data transmitted from the timing controller to the current pixel data, wherein the encoding block includes:

a memory block sequentially storing the pixel data corresponding to at least one line of the current pixel data as the previous pixel data;

a vertical control block comparing the previous pixel data stored in the memory block with the current pixel data to generate the first data, first control signal and the first data transition number;

a horizontal control block comparing the current pixel data with the former pixel data to generate the second data, the second control signal and the second data transition number; and an output part generating the modified data, the vertical control signal and the horizontal signal by using the first and second data, the first and second control signals and the first and second data transition numbers, and, wherein the output part includes:

a third comparator comparing the first data transition number with the second data transition number to produce a first comparison control signal if the first data transition number is larger than the second data transition number and, otherwise, to produce a second comparison control signal;

a controller receiving the first control signal, the second control signal, the first data, the second data and any one of the first comparison control signal and the second comparison control signal produced by the third comparator;

a vertical control signal generator generating the vertical control signal under the control of the controller;

a horizontal control signal generator generating the horizontal control signal under the control of the controller; and a data generator for the modified data controlled by the controller.

2. The apparatus for driving the liquid crystal display device of claim 1, wherein the encoding block supplies an inverted or a non-inverted horizontal control signal to the decoding block in response to the comparison result of the current pixel data with the previous pixel data, and wherein the encoding block supplies an enabled or a disabled vertical control signal to the decoding block in response to the number of transitions for each bit.

3. The apparatus for driving the liquid crystal display device of claim 1, wherein the memory block has two line memories, each line memory storing the data supplied from the exterior and supplying the stored data to the vertical control block.

4. The apparatus for driving the liquid crystal display device of claim 1, wherein the vertical control block includes:

a first comparator comparing the current pixel data with the previous pixel data to determine whether or not the number of transitions for each bit is more than a predetermined threshold value, and supplying a modification control signal upon a determination that the transition number for the pixel data is greater than the predetermined threshold value or supplying a maintaining control signal otherwise;

a first data generator generating the first data by inverting or non-inverting the current pixel data under the modification or maintaining control signal of the first comparator and generating the first data transition number corresponding to the number of transitions for each bit between the first data and the previous pixel data; and a first control signal generator generating the first control signal representative of the inversion or the non-inversion of the first data under the modification or maintaining control signal of the first comparator.

5. The apparatus for driving the liquid crystal display device of claim 4, wherein the predetermined threshold value is set to a half of a number of overall bits in the pixel data.

6. The apparatus for driving the liquid crystal display device of claim 4, wherein the first data generator, in response to the modification control signal, inverts the current pixel data to generate the first data.

7. The apparatus for driving the liquid crystal display device of claim 4, wherein the first data generator, in response to the maintaining control signal, provides the current pixel data as the first data to the output part.

8. The apparatus for driving the liquid crystal display device of claim 4, wherein the first control signal generator generates the first control signal in an enabled state when receiving the modification control signal and wherein the first control signal generator generates the first control signal in a disabled state when receiving the maintaining control signal.

9. The apparatus for driving the liquid crystal display device of claim 1, wherein the horizontal control block includes:

a second comparator comparing the current pixel data with the former pixel data to determine whether or not the number of transitions for each bit is more than a predetermined threshold value, and supplying a modification control signal upon a determination that the transition number for each bit is more than the predetermined threshold value, or supplying a maintaining control signal otherwise;

a second data generator generating the second data by inverting or non-inverting the current pixel data under the modification or maintaining control signal of the second comparator and generating the second data transition number corresponding to the number of transitions for each bit between the second data and the former pixel data; and a second control signal generator generating the second control signal representative of the inversion or the non-inversion of the second data under the modification or maintaining control signal of the second comparator.

10. The apparatus for driving the liquid crystal display device of claim 9, wherein the second data generator inverts the current pixel data to generate the second data when receiving the modification control signal.

11. The apparatus for driving the liquid crystal display device of claim 9, wherein the second data generator, when receiving the maintaining control signal, provides the current pixel data as the second data to the output part.

12. The apparatus for driving the liquid crystal display of claim 9, wherein the second control signal generator generates the second control signal in an enabled state when receiving the modification control signal and wherein the second control signal generator generates the second control signal in a disabled state when receiving the maintaining control signal.

13. The apparatus for driving the liquid crystal display device of claim 1, wherein the controller controls the vertical control signal generator to generate the vertical control signal in a disabled state when receiving the first comparison control signal.

14. The apparatus for driving the liquid crystal display device of claim 1, wherein the controller controls the vertical control signal generator to generate the vertical control signal in an enabled state when receiving the second comparison control signal.

15. The apparatus for driving the liquid crystal display device of claim 1, wherein the controller controls the horizontal control signal generator to invert the horizontal control signal when receiving the second control signal in an enabled state, and, otherwise, the controller controls the horizontal control signal generator to maintain the horizontal control signal as a non-inverted state.

16. The apparatus for driving the liquid crystal display device of claim 1, wherein the controller generates the second data as the modified data when receiving both of the first comparison control signal and the disabled second control signal.

17. The apparatus for driving the liquid crystal display device of claim 1, wherein the controller generates the second data as the modified data when receiving both of the first comparison control signal and the enabled second control signal.

18. The apparatus for driving the liquid crystal display device of claim 1, wherein the controller generates the modified data by using the data generator if the second comparison control signal is provided to the controller.

19. The apparatus for driving the liquid crystal display device of claim 18, wherein the controller supplies the first data to the data generator when receiving the second comparison control signal.

20. The apparatus for driving the liquid crystal display device of claim 1, wherein the data generator includes:

a first exclusive-OR gate performing an exclusive-OR operation on the first data and the previous pixel data; and a second exclusive-OR gate performing an exclusive-OR operation on the output of the first exclusive-OR gate and the former pixel data.

21. The apparatus for driving the liquid crystal display device of claim 20, the controller generates the output of the second exclusive-OR gate as the modified data.

22. The apparatus for driving the liquid crystal display device of claim 1, wherein the decoding block includes:

a fourth comparator that determines whether the horizontal control signal is inverted or not, producing a third comparison control signal if the horizontal control signal is inverted, or, otherwise, producing a fourth comparison control signal;

a decoding controller receiving any one of the third comparison control signal and the fourth comparison control signal produced by the fourth comparator, the vertical control signal and the modified data;

a data inverter inverting the modified data under a control of the decoding controller;

a data recovery part recovering the modified data under the control of the decoding controller; and a selector selectively outputting any one of the modified data from the decoding controller, the inverted modified data from the data inverter and the recovered data from the data recovery part, under the control of the decoding controller.

23. The apparatus for driving the liquid crystal display device of claim 22, further comprising:

a first delay part in any one input terminal of two input terminals in the fourth comparator delaying the horizontal control signal by a time interval during which one pixel data is supplied;

a second delay part delaying the modified data by one pixel to supply the delayed data to the data recovery part; and a memory sequentially storing the output data from the selector by at least one line to supply the stored data to the data recovery part.

24. The apparatus for driving the liquid crystal display device of claim 22, wherein the decoding controller provides the modified data to the selector and controls the selector to output the modified data when receiving the fourth comparison control signal and the vertical control signal in a disabled state.

25. The apparatus for driving the liquid crystal display device of claim 22, wherein the decoding controller provides the modified data to the data inverter and controls the selector to output the inverted modified data when receiving the third comparing control signal and the vertical control signal in a disabled state.

26. The apparatus for driving the liquid crystal display device of claim 22, wherein the decoding controller recovers the data by using the data recovery part when receiving the enabled vertical control signal.

27. The apparatus for driving the liquid crystal display device of claim 26, wherein the decoding controller provides the inverted modified data to the data recovery part when receiving the third comparison control signal, and wherein the decoding controller provides the modified data to the data recovery part when receiving the fourth comparison control signal.

28. The apparatus for driving the liquid crystal display device of claim 27, wherein the decoding controller includes:

a first exclusive-OR gate performing an exclusive-OR operation on the inverted modified data or the modified data and the former pixel data; and a second exclusive-OR gate performing an exclusive-OR operation on the output of the first exclusive-OR gate and the previous pixel data.

29. The apparatus for driving the liquid crystal display device of claim 28, wherein the recovered data from the second exclusive-OR gate is provided to the selector and the controller controls the selector so as to output the recovered data from the selector.

30. The apparatus for driving the liquid crystal display device of claim 1, wherein the decoding block is installed in the data driver and supplies the recovered data to a plurality of data integrated circuits.

31. The apparatus for driving the liquid crystal display of claim 1, wherein the data driver includes a plurality of data integrated circuits and wherein the decoding block is installed in each of data integrated circuits included in the data driver.

32. A method of driving a crystal display device, comprising:

generating a first data, a first control signal and a first data transition number by comparing current pixel data with previous pixel data delayed by one line from the current pixel data;

generating a second data, a second control signal and a second data transition number by comparing current pixel data with former pixel data which is preceded by one pixel from the current pixel data;

generating a modified data, a vertical control signal and a horizontal signal by using the first and second data, the first and second control signals and the first and second data transition numbers so as to minimize the number of transitions for each bit;

transmitting the modified data, the vertical control signal and the horizontal control signal from a timing controller to a data driver;

recovering the current data from the transmitted modified data by using vertical control signal and the horizontal control signal, and driving the data lines with the current data, wherein the step of generating a modified data, a vertical control signal and a horizontal signal includes:

comparing the first data transition number with the second data transition number to produce a first comparison control signal if the first data transition number is larger than the second data transition number or, otherwise, to produce a second comparison control signal;

generating the vertical control signal in a disabled state when producing the first comparison control signal, or the vertical control signal in an enabled state when producing the second comparison control signal;

inverting the horizontal control signal when the second control signal is in an enabled state, or, otherwise, maintaining the horizontal control signal as a non-inverted state; and generating the modified data if the second comparison control signal is produced.

* * * * *